United States Patent [19]

Nakatomi

[11] Patent Number: 5,075,727

[45] Date of Patent: Dec. 24, 1991

[54] DEVELOPING DEVICE FOR IMAGE FORMING APPARATUS

[75] Inventor: Yoshitsugu Nakatomi, Yokosuka, Japan

[73] Assignee: Kabushiki Kaisha Toshiba, Kawasaki, Japan

[21] Appl. No.: 584,711

[22] Filed: Sep. 19, 1990

[30] Foreign Application Priority Data

Sep. 29, 1989 [JP] Japan ..... 1-254928
Dec. 14, 1989 [JP] Japan ..... 1-322720

[51] Int. Cl.[5] ..... G03G 15/06

[52] U.S. Cl. ..... 355/260; 118/653; 355/245

[58] Field of Search ..... 355/260, 259, 215, 245, 355/200, 210; 118/644, 653; 346/160; 358/401; 141/114, 1; 222/DIG. 1

[56] References Cited

U.S. PATENT DOCUMENTS 2,819,738 1/1958 Marberg ..... 141/1
4,089,601 5/1978 Navone ..... 355/245
4,236,485 12/1980 Inukai et al. ..... 118/690
4,321,886 3/1982 Azuma ..... 118/689
4,803,510 2/1989 Maeda ..... 355/210
4,956,668 9/1990 Arnold et al. ..... 355/260 X

FOREIGN PATENT DOCUMENTS 0168469 9/1984 Japan .
0210869 9/1988 Japan .

*Primary Examiner*—A. T. Grimley
*Assistant Examiner*—Sandra L. Brase
*Attorney, Agent, or Firm*—Foley & Lardner

[57] ABSTRACT

A developing device includes a casing removably mounted in an image forming apparatus and having a storing chamber in which developer is to be supplied. A package sealing developer therein is housed in the storing chamber. After the device is set in the image forming apparatus, the package is opened by an opening mechanism so as to supply the developer in the package into the storing chamber.

15 Claims, 8 Drawing Sheets

DEVELOPING DEVICE FOR IMAGE FORMING APPARATUS

Background of the Invention

1. Field of the Invention

The present invention relates to a developing device for an image forming apparatus such as a laser printer.

2. Description of the Related Art

An image forming apparatus usually includes a process forming system for carrying out charging, exposing, developing, transferring, paper sheet separating, cleaning and other steps. In this system, a developing device usually includes a casing in which a developing roller is housed. In the casing is defined a storing chamber for storing developer which is to be supplied. According to developing devices disclosed in U.S. Pat. Nos. 4,236,485 and 4,321,886, for example, a toner supply unit is mounted on the casing and the toner is supplied from the unit into a storing chamber defined in the casing, depending upon the amount of the toner left in the storing chamber.

Further, there has been proposed an image forming apparatus wherein the developing device of the process forming system is made as a unit which is removably arranged in the body of the image forming apparatus. According to the image forming apparatus of this kind, the developing unit is detached from the apparatus body and exchanged with a new one, when the image forming apparatus is operated for a predetermined time period or when developer in the developing unit is used up. One of these developing units is intended to previously store the developer in the chamber of the unit before the unit is set in the apparatus body, while the other thereof to supply the developer into the chamber of the unit after the unit is set in the apparatus body.

In the case of the former, however, it is supposed that the toner in the storing chamber leaks or scatters outside the casing of the developing unit by vibration and impact caused when the unit is dropped during transport. In order to prevent the leaking or scattering of the toner, therefore, upon transporting the unit, some clearances of the unit must be closed by various kinds of seal members. This makes it troublesome to package the developing unit. In addition, the seal members must be removed from the developing unit when the unit is to be set in the apparatus body. This also makes it troublesome to set the unit in the apparatus body.

In the case of the latter developing unit, it is needed that the toner is supplied into the storing chamber through an opening formed in the wall of the casing of the developing unit after the unit is set in the apparatus body, thus being troublesome in operation. In addition, the toner is likely to be scattered on the outer face of the unit or in the apparatus body when the toner is being supplied into the storing chamber. The developing unit itself and its surroundings are thus dirtied by the toner.

SUMMARY OF THE INVENTION

The present invention is therefore intended to eliminate the above-mentioned drawbacks.

Accordingly, the object of the present invention is to provide a developing device more easily set in the body of the image forming apparatus and capable of reliably preventing toner from leaking and scattering outside the developing device while the device is being transported.

According to the present invention, this object can be achieved by a developing device comprising a casing for storing developer therein; a package housed in the casing and in which developer is sealed; and means for opening the package to supply the developer in the package into the casing.

With the developing device having the abovedescribed arrangement, the developer is held in the casing while being sealed in the package. Even when vibration and impact are applied to the casing during transporting the developing device, therefore, the developer in the package can be prevented from leasing and scattering into the casing or outside the casing In addition, the package can be made, transported and stored independently of the casing.

Further, the developer is held with being sealed in the package until the developing device is set in the body of the image forming apparatus, and the package is opened by the opening means to supply the developed into the casing after the developing device is set in the apparatus body. This makes it easier to set the developing device in the apparatus body and prevents the developer from scattering outside the developing device and in the apparatus body.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 through 8 show a developing device according to an embodiment of the present invention, in which:

FIG. 1 is a sectional view of an image forming apparatus provided with the developing device, FIG. 2 is an exploded perspective view of the developing device, FIG. 3 is a perspective view of the developing device, FIG. 4 is a sectional view taken along a line IV—IV in FIG. 3, FIG. 5 is a sectional view taken along a line V—V in FIG. 3, FIG. 6 is a perspective view showing a package, FIG. 7 is a perspective view showing part of the package enlarged, and FIG. 8 is a perspective view showing a plug;

FIGS. 9 through 14 show a developing device according to a second embodiment of the present invention, in which:

FIG. 9 is a perspective view showing the whole of the developing device,

FIG. 10 is a sectional view taken along a line X—X in FIG. 9,

FIG. 11 is a sectional view taken along a line XI—XI in FIG. 9,

FIG. 12 is a perspective view showing a package,

FIG. 13 is a sectional view showing state where part of the package is drawn into a package housing chamber, and FIG. 14 is a sectional view showing a state where the whole of the opened package is drawn into the package housing chamber;

FIGS. 18 through 20 show a developing device according to a third embodiment of the present invention, in which:

FIG. 18 is a perspective view showing the whole of the developing device,

FIG. 19 is a sectional view showing the developing device, and

FIG. 20 is an enlarged sectional view showing a package housing chamber of the developing device.

DETAILED DESCRIPTION OF THE PREFERRED EMBODIMENTS

Preferred embodiments of the present invention will be described in detail with reference to the drawings.

Figure 1:
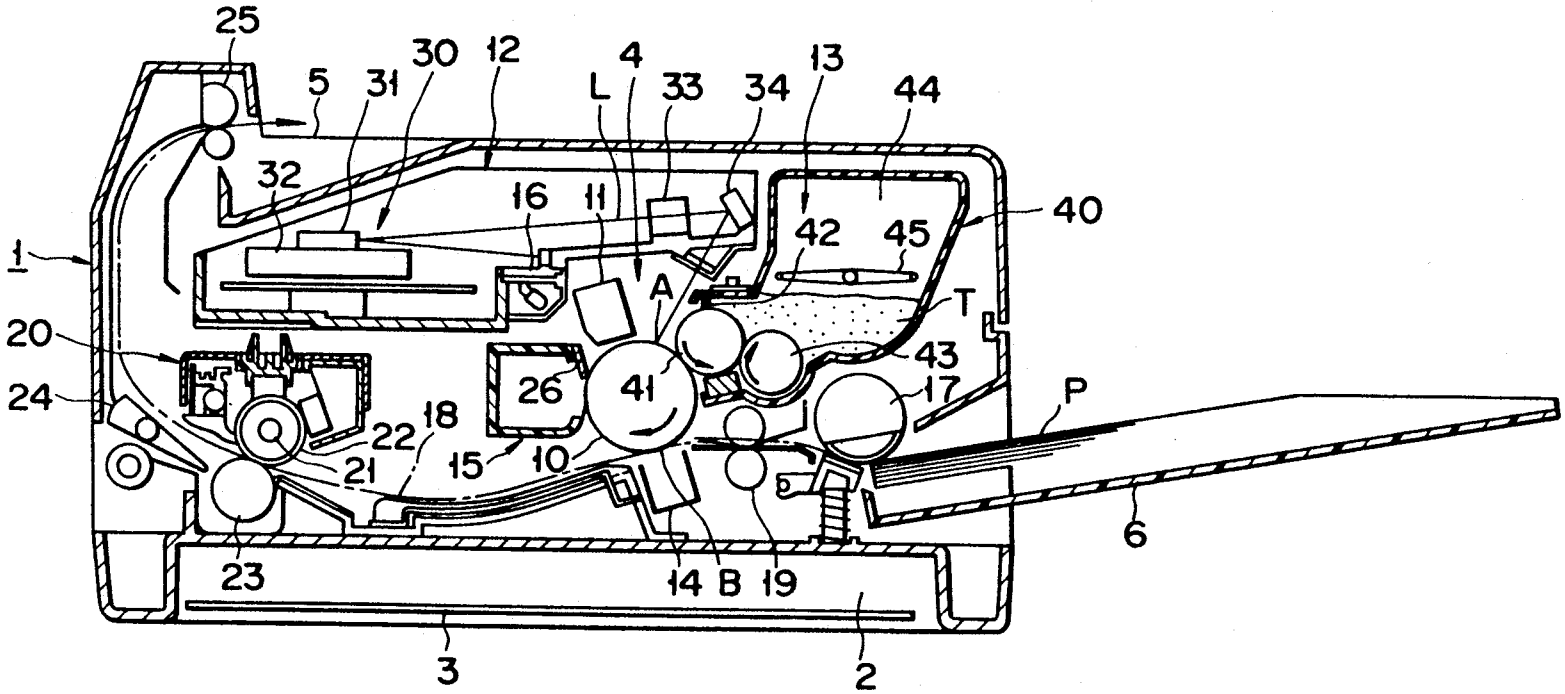
Figure 2:
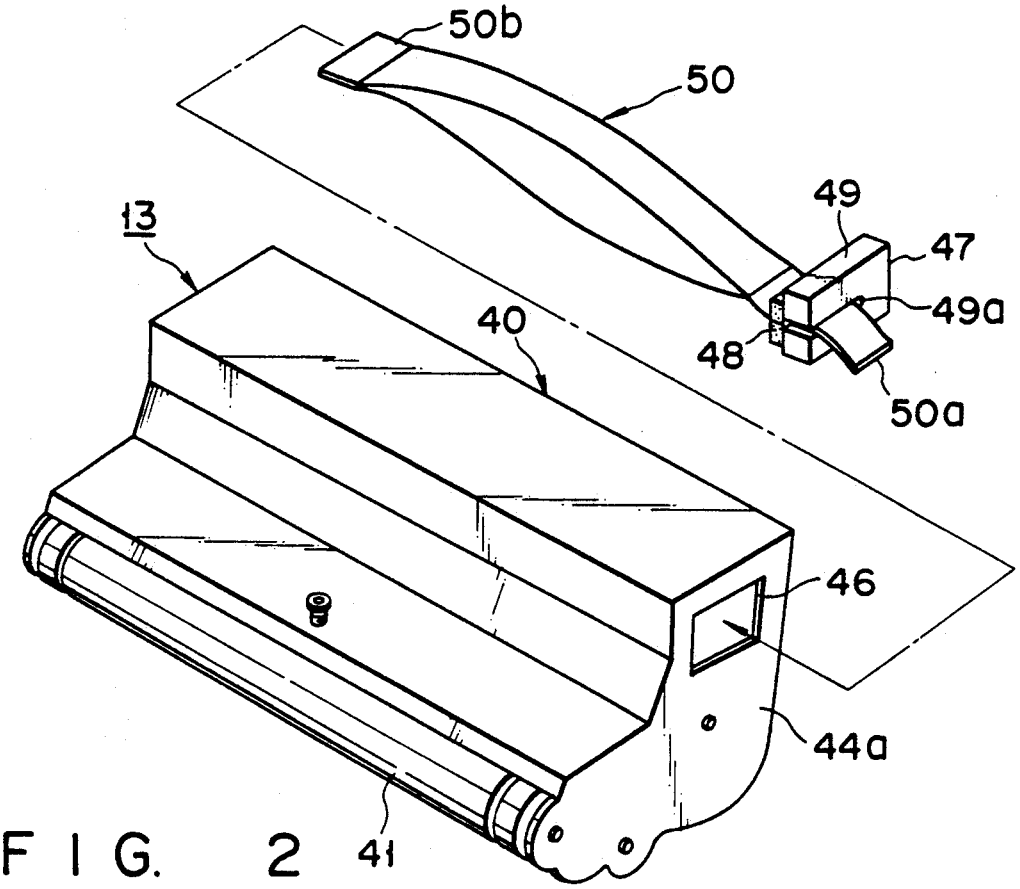
Figure 3:
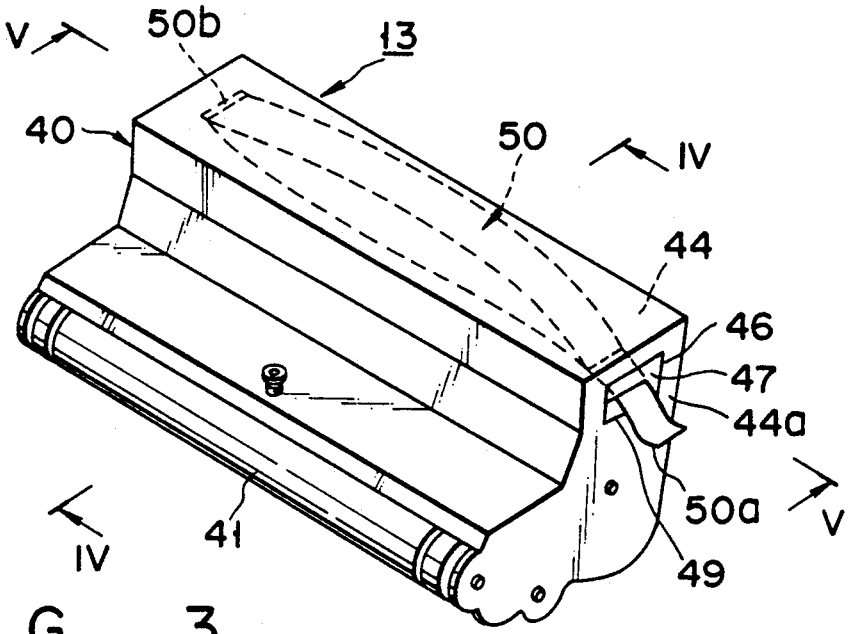

FIG. 1 shows a laser printer as an image forming apparatus provided with a developing device according to an embodiment of the present invention. As shown in FIG. 1, the laser printer has an apparatus body 1, in the bottom portion of which is formed a housing section 2 for housing a plurality of additional functions control boards (not shown). A main control board 3 is housed in this section 2. An electrophotographic processing system for forming an image is arranged above the section 2, and a paper discharge section 5 having a recess is formed on the top of the apparatus body 1. A paper cassette 6 for supplying sheets of paper P to the system 4 is attached to the right side of the apparatus body 1.

The arrangement of the system 4 for carrying out the electrophotographic processes which includes charging, exposing, developing, image-transferring, paper-separating, drum-cleaning, image-fixing and other steps will be described.

The system 4 has a photoconductive drum 10 which is located substantially in the center of the body 1 to serve as an image carrier. Arranged around the drum 10 in the rotating direction thereof are a charger 11 formed of a scorotron, an exposing section A of a laser exposing unit 12 which serves as the electrostatic latent image forming means, a developing unit 13 of a magnetic brush type carrying out developing step, a transferring charger 14 formed of a corotron, a cleaning unit 15 and an erasing unit 16.

In the apparatus body 1 is formed a paper feeding passage 18 for feeding paper sheets P, which have been supplied from the paper cassette 6 by means of a paper supply system 17, to the discharge section 5 through an image transfer section B between the drum 10 and the transfer charger 14. Aligning rollers 19 are located upstream the image transfer section B in the passage 18 and a fixing unit 20 is located downstream the image transfer section B.

The fixing unit 20 includes a heat roller 22 in which a heater lamp 21 is housed, and a press roller 23 pressed against the heat roller 22. When a paper sheet P on which a toner image has been transferred at the transfer section B is passed between the rollers 22 and 23, the toner image is melted and fixed on the paper sheet P.

In FIG. 1, reference numeral 24 represents a guide for changing the feeding direction of paper sheets P, located downstream the fixing unit 20, and reference numeral 25 represents discharge rollers for discharging paper sheets P, on which images have been fixed, to the discharge section 5.

The exposing unit 12 includes a semiconductor laser oscillator (not shown), a polygon scanner 30 having a polygon mirror 31 and a mirror motor 32, an $f\theta$ lens 33, a reflecting mirror for guiding scanning laser beam L to the exposing section A, and the like.

The photosensitive drum 10 is arranged in the apparatus body 1 to be removable therefrom integrally with the cleaning unit 15 but independent of the developing unit 13.

Figure 4:
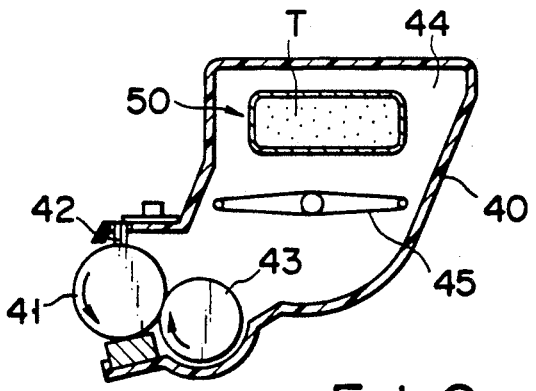

In order to simplify the electrophotographic processes, the developing unit 13 employs the reversal developing manner and has an arrangement which will be shown in detail in FIG. 4.

More specifically, the developing unit 13 has a casing 40 having a toner storing chamber 44 therein, a developing roller 41 arranged in the casing 40 to oppose to the photoconductive drum 10, a blade 42 arranged in the casing 40 and contacting with the surface of the developing roller 41 to charge toner T serving as one-component developer, a collecting roller 43 located adjacent to the developing roller 41 in the casing 40, and a toner stirrer 45 for uniformly stirring toner T housed in the chamber 44. The collecting roller 43 is rotated in a direction reverse to the direction in which the developing roller 41 is rotated, so as to scrape off toner T remaining on the developing roller 41. The developing unit 13 having the above-described arrangement is removably set in the apparatus body 1 independent of other components.

When the above-described laser printer receives a print start signal from the host system, the drum 10 is rotated and charged by the charger 11.

The drum 10 is then scanned and exposed at the exposing section A of the laser exposing unit 12, which the polygon scanner 30, by laser beam L modulated responsive to dot image data applied from the host system, and an electrostatic latent image which corresponds to image signals is thus formed on the drum 10. The electrostatic latent image on the drum 10 is developed by toner T in the developing unit 13 to form a toner image.

A paper sheet P picked up from the paper cassette 6 by the paper supply system 17, synchronizing with the toner image forming operation, is fed to the transfer section B through aligning rollers 19. The toner image on the drum 10 is transferred to the paper sheet P at the transfer section B by the transfer charger 14.

The paper sheet P on which the toner image has been transferred is fed to the fixing unit 20, passing through the passage 18, and the toner image is melted and fixed there on the paper sheet P, which is then discharged to the discharge section 5 through the discharging rollers 25.

Toner remaining on the drum 10 after the transfer process is scraped off by a blade 26 made of elastic rubber, and it is thus collected in the cleaning unit 15.

As shown in FIGS. 2 through 5, before the developing unit 13 is set in the apparatus body 1 of the printer, toner T is located above the stirring member 45 in the storing chamber 44 of the casing 40 while being sealed in a package 50.

Figure 6:
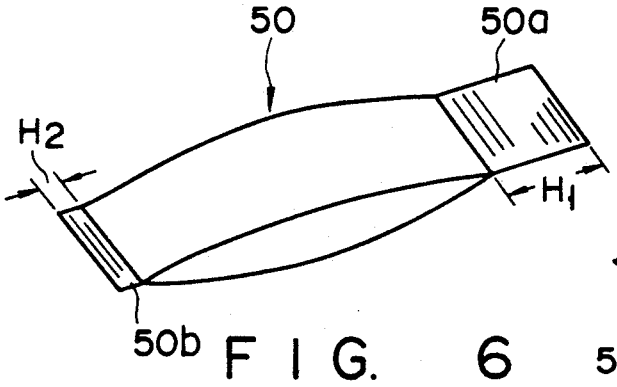
Figure 7:
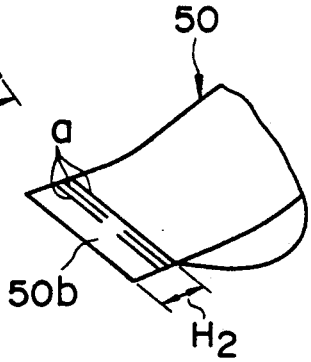
Figure 8:
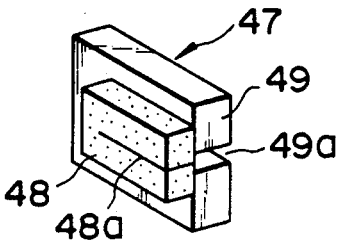

As shown in FIGS. 6 and 7, the package 50 is cylindrical and made of plastic film, and both its axial ends 50*a* and 50*b* are sealed by means of high frequency welding. A welded area H2 at the end portion 50*b* of the package 50, which is inserted at first into the chamber 44, is relatively small, and only one of three welding lines a seals the end portion 50*b*, over all of its length. Therefore, the sealing strength of the end portion 50*b* of the package 50 is adjusted so as to allow the end portion 50*b* to be easily opened by internal pressure generated in the package 50. The other end portion 50*a* of the package 50 forming a grip portion which will be described later is welded at a relatively large area H1 and completely sealed not to open even when internal pressure is generated in the package 50.

A side wall 44*a* of the casing 40 of the developing unit 13 is provided with an opening 46 having such a size that allows the package 50 to pass through it. The end 50*b* of the package 50 is inserted at first into the casing 40 through the opening 46, and the other end 50*a* thereof projects outside the casing 40 through the opening 46. The opening 46 is closed by a plug 47.

As shown in FIGS. 2, 3, 5 and 8, the plug 47 includes a body 49 which is fitted into the opening 46 and provided with a slit 49*a*, and a seal member 48 fixed to the inner face of the body 49, located in the casing 40, and made of elastic matter such as sponge. The seal member 48 has a slit 48*a* corresponding to the slit 49*a* of the body 49, and this slit 48*a* is closed by the elasticity of the seal member itself. Therefore, the slit 49*a* of the body 49 is also closed by the seal member 48. The end 50*a* of the package 50 extends outside the casing 40, passing through the slits 48*a* and 49*a*.

The package 50 is to be opened in the following manner, after the developing unit 13 is set in the apparatus body 1 of the printer.

Figure 5:
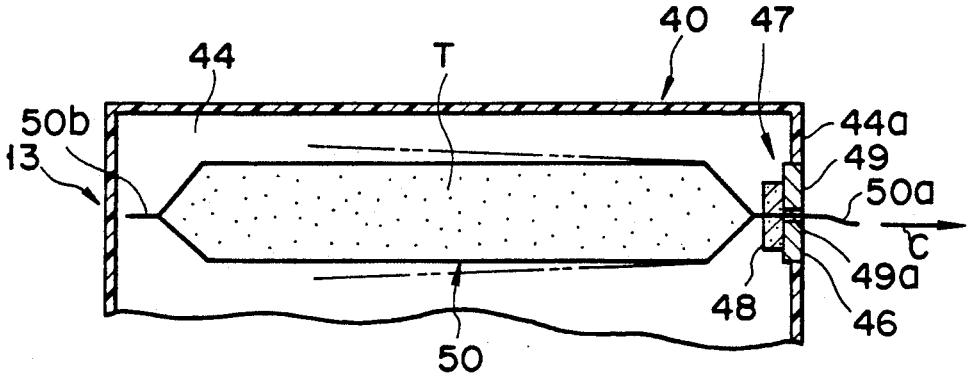

The end 50*a* of the package 50 which extends outside the casing 40, serving as the grip portion, is pulled in a direction shown by an arrow C in FIG. 5 so that the whole of the package 50 is drawn out of the casing 40 through the slits of the plug 47 and the opening 46 Upon drawing out the packages 50, the package is squeezed by the plug 47 to thereby push the toner in the package 50 toward the end 50*b* thereof. Pressure in the package 50 is thus gradually increased, the welded portions at the end 50*b* of the package 50 are thus pulled apart. As the result, the end 50*b* of the package 50 is opened. As the package 50 is further pulled out of the casing 40, the toner T is pushed out of the package 50 through the opened end 50*b* thereof into the storing chamber 44 in the casing 40, as shown in FIG. 1.

The package 50 completely pulled out of the casing 40 is then disposed of. The slit 49*a* of the plug 47 is closed by the seal member 48 while the package 50 is being pulled and after it is completely pulled out of the casing 40. This prevents the toner T pushed out of the package 50 from scattering outside the casing 40 through the slit 49*a* of the plug 47.

According to the developing unit 13 having the above-described arrangement, the toner which serves as developer is arranged in the storing chamber 44 of the casing 40 while being sealed in the package 50. Even when vibration and impact are added to the casing 40 during transportation of the developing device, for example, therefore, the toner in the package is neither leaked nor scattered in and outside the casing. Further, the package 50 can be made, transported, stored and so on, independently of the casing 40.

When the developing unit is to be set in the body of the printer, the conventional operations such as removing seal members from the unit, can be made unnecessary to thereby make it easier to set the developing unit in the apparatus body. In addition the package can be opened by the simpler operation of only pulling it out of the casing.

The opening 46 through which the package 50 is inserted into the container 40 may be formed not only in the side wall of the casing but also in the top or rear wall thereof.

FIGS. 9 through 15 show a second example of the developing device or unit according to the present invention. Same components in the second example as those in the first one will be denoted by same reference numerals and description on these components will be omitted.

According to the second example, the developing unit 13 is provided with a mechanism 52 for winding the package 50, which serves as means for opening the package.

Figure 9:
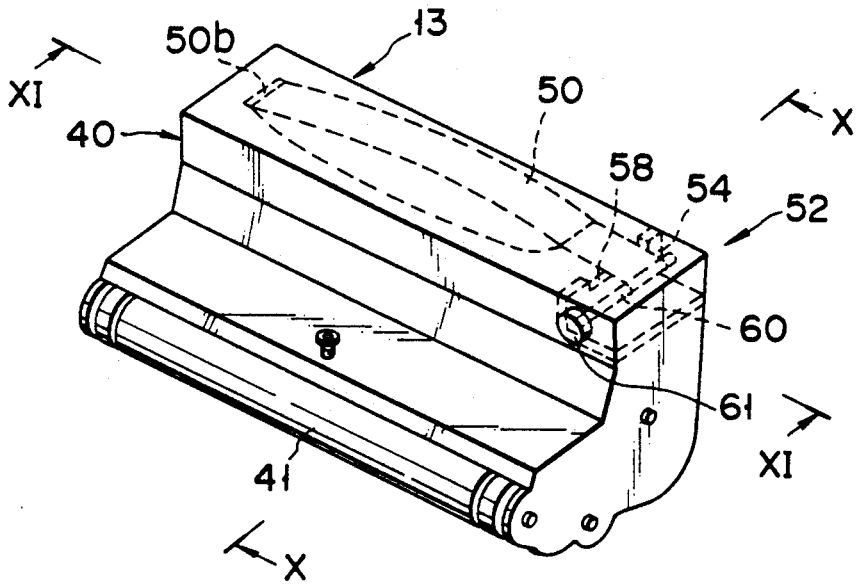
Figure 10:
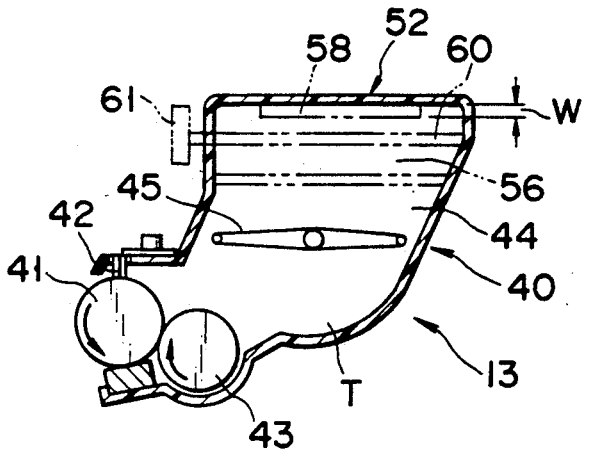
Figure 11:
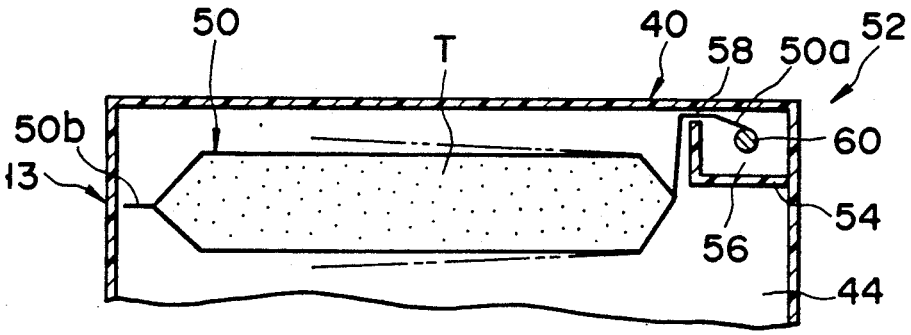

As shown in detail in FIGS. 9 through 11, the winding mechanism 52 has a substantially L-shaped partition wall 54 located at one upper corner of the casing 40 of the developing unit 13, in short, at such a position in the casing 40 that does not interfere with a stirring member 45 in the storing chamber 44. A package collecting chamber 56 is defined by the partition wall 54 and the walls of the casing 40. A slit-like opening 58 is formed between one end of the partition wall 54 and the top of the casing 40 and the collecting chamber 56 communicates with the storing chamber 44 through the opening 58. The width W of the opening 58 is set equal to that of the package 50 in which the toner is not sealed yet. A winding shaft 60 which is rotatably supported by the walls of the casing 40 is arranged in the collecting chamber 56. One end of the winding shaft 0 projects outside the casing 40, passing through the wall thereof, and a knob 61 for rotating the winding shaft 60 by hand is attached to the projected end of the shaft 60.

Figure 12:
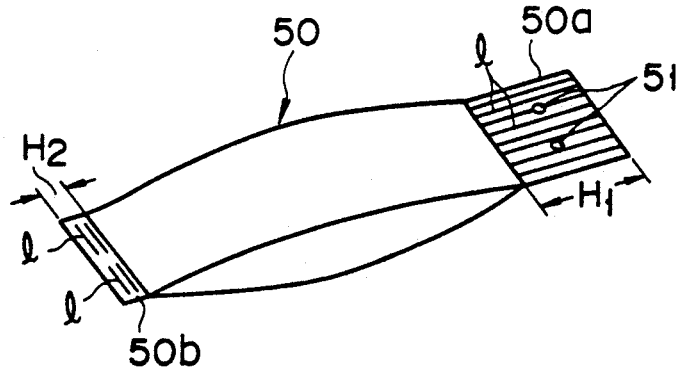

On the other hand, the package 50 housed in the storing chamber 44 of the casing 40 has an end portion 10*b* which is so sealed as to be easily opened, and the other end portion 50*a* which is completely welded not to be opened, as shown in FIG. 12. A pair of engage holes 1 are formed in the end portion 50*a* of the package 50. This end portion 50*a* is inserted into the package collecting chamber 56 through the opening 58 formed in the partition wall 54, and it is wound round the winding shaft 60. Positioning projections (not shown) project from the winding shaft 60 and are engaged with the engage holes 51 at the end portion 50*a* of the pack ge 50. This prevents the end portion 50*a* from slipping off the winding shaft 60 and therefore enables it to be reliably wound by the shaft 60 as the shaft 60 is rotated.

Figure 13:
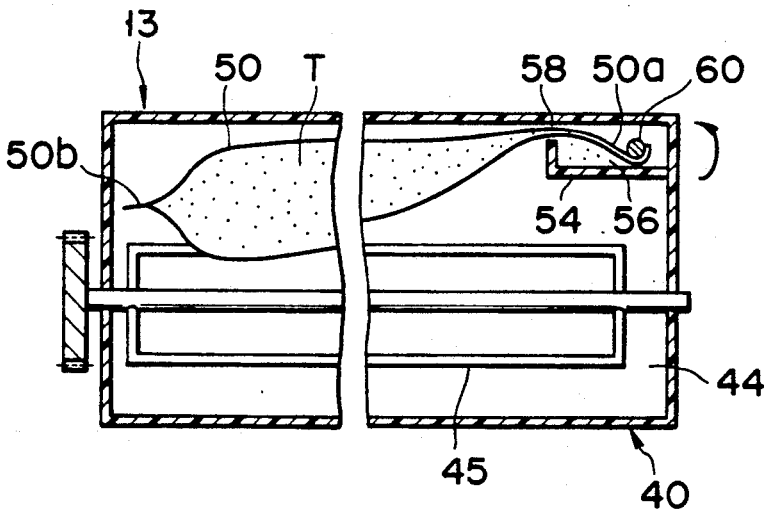
Figure 14:
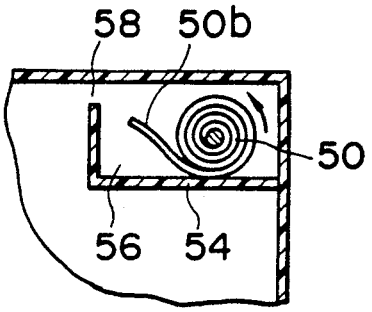

According to the developing unit having the abovedescribed arrangement, the package 50 can be opened and the toner in the package 50 can be supplied into the storing chamber 44 by rotating the knob 61 to wind the package 50 round the winding shaft 60 after the developing unit is set in the apparatus body of the printer. More specifically, when the winding shaft 60 is rotated by the knob 61, the end portion 50*a* of the package 50 is wound by the winding shaft 60 and the whole of the package 50 is drawn into the collecting chamber 56 through the opening 58, as shown in FIG. 13. When the package 50 is passed through the opening 58, it is squeezed by the edge portion of the partition wall 54 defining the opening 58, and the toner in the package is pushed against its end 50*b*. Pressure in the package 50 is thus increased and the welded portions at the end portion 50*b* of the package 50 are pulled apart and opened by the pressure thus increased in the package 50 When the package 50 is then further wound by the winding shaft 60, the toner in the package 50 is pushed through the opened end 50*b* to drop in the storing chamber 44. The empty package 50 is wound up by the winding shaft 60 and housed in the collecting chamber 56, as shown in FIG. 14.

Also with the second embodiment, the same merits as those achieved by the first example can be attained.

Figure 15:
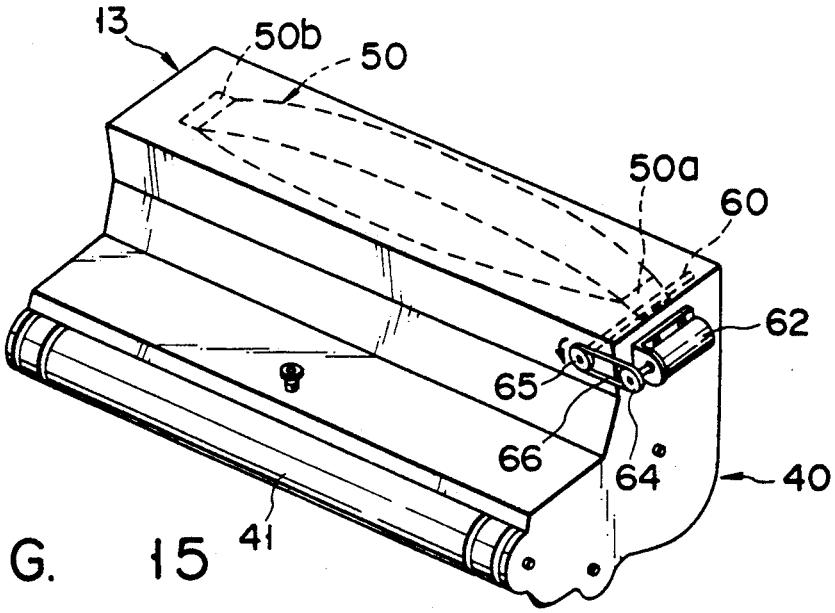
FIG. 15 is a perspective view showing a first modification of the developing device in the second embodiment.

Although the winding of the developer package 50 has been carried out by rotating the knob 61 by hand in the case of the second example, it may be arranged that a drive motor 62 is attached to the outer face of the casing 40 of the developing unit 13 and that the winding shaft 60 is automatically rotated by the motor 62 via pulleys 64, 65 and a timing belt 66, as shown in FIG. 15.

In this case, when the developing unit 13 is set in the apparatus body 1 of the printer, for example, a connector (not shown) connected to the main control substrate 3 (see FIG. 1) on the side of the apparatus body 1 is connected to a connector (not shown) on the side of the developing unit 13 and the motor 62 is controlled by the main control substrate 3 to rotate only for a previously set time period.

Figure 16:
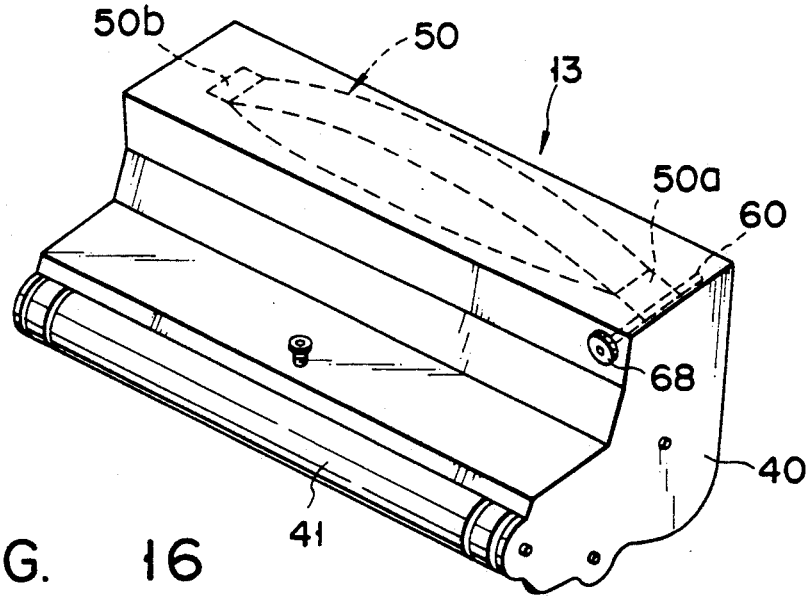
FIG. 16 is a perspective view showing a second modification of the developing device in the second embodiment.
Figure 17:
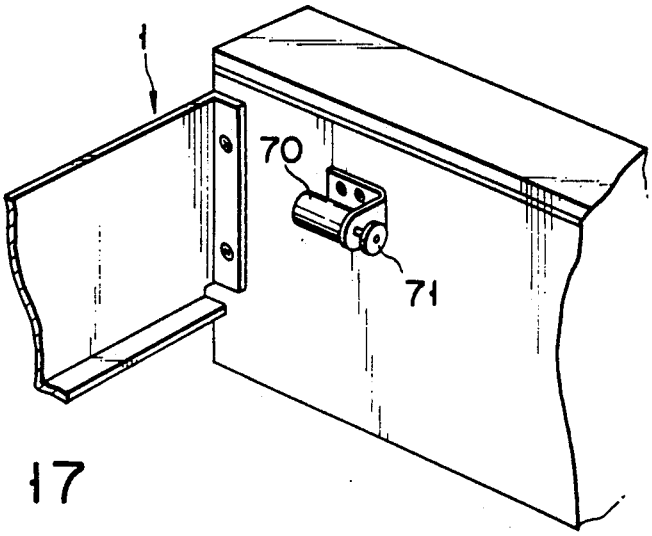
FIG. 17 is a perspective view showing a part of the apparatus body to which the developing device according to the second modification is attached.

As shown in FIGS. 16 and 17, it may be arranged that a gear 68 is attached to one end of the winding shaft 60 projecting outside the casing 40 of the developing unit 13 and that the gear 68 is engaged with a gear 71 of a drive motor 70 arranged on the side of apparatus body 1, when the developing unit 13 is set in the apparatus body 1. The winding shaft 60 can be automatically rotated by the motor 70.

As in the first variation of the second example, the motor 70 is also controlled by the main control substrate 3 on the side of the apparatus body 1 to rotate for a predetermined time period after the developing unit 13 is set in the apparatus body 1.

Figure 18:
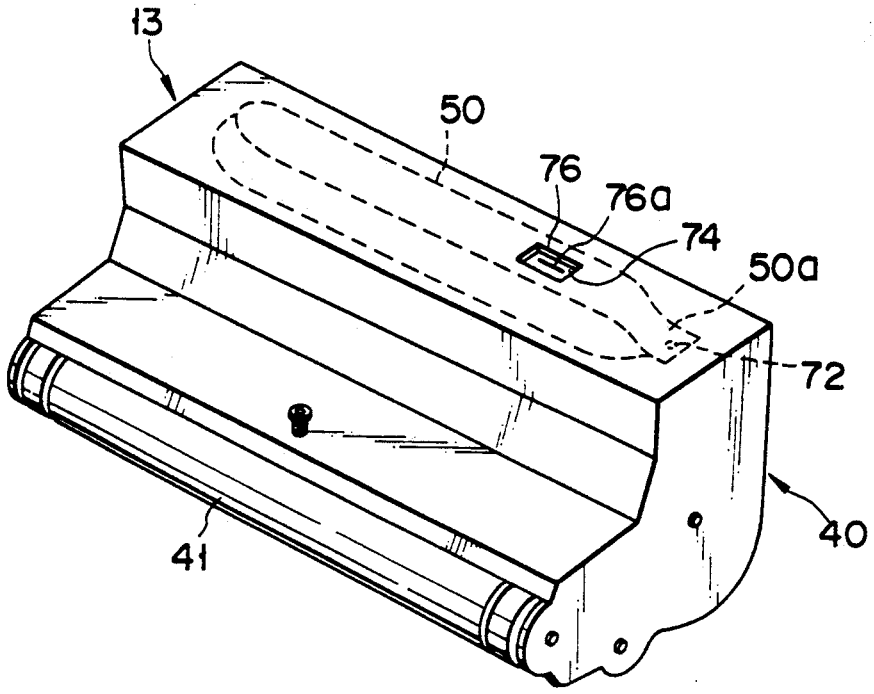
Figure 19:
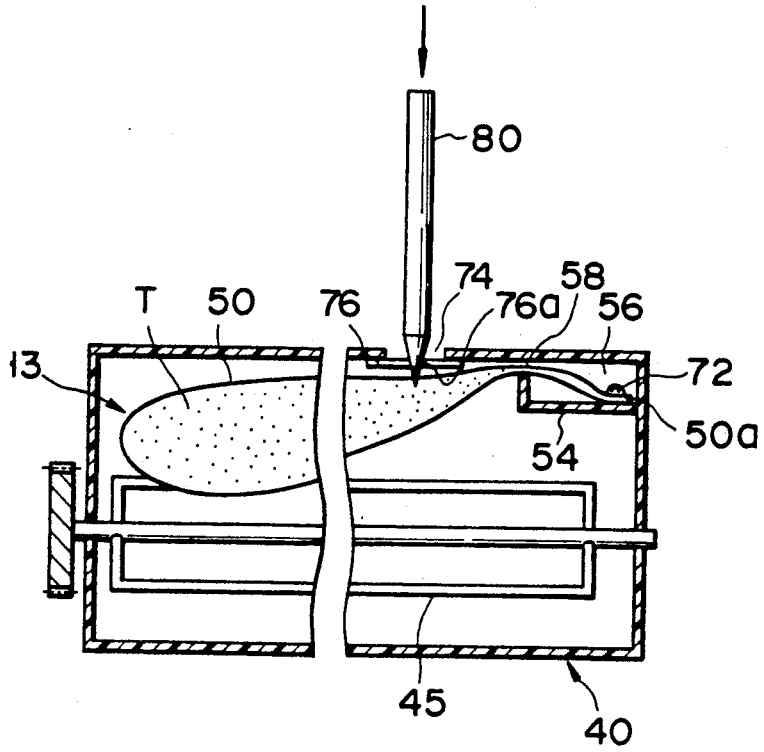
Figure 20:
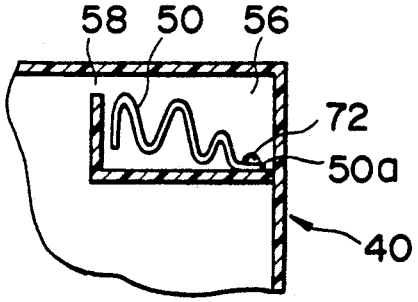

FIGS. 18 through 20 show a third embodiment of the developing device according to the present invention.

According to this embodiment, a package collecting chamber 56 is defined by a substantially L-shaped partition wall 54 at one upper corner of the casing 40 of the developing unit 13, that is, at such a position that does not interfere with a stirring member 45 in the storing chamber 44. A slit-like opening 58 is formed in the partition wall 54 and the collecting chamber 56 communicates with the storing chamber 44 through the opening 58. A toner package 50 housed in the storing chamber 44 is made of elastic material such as rubber and shaped like a bag or balloon. The package 50 is elastically expanded by sealing toner T in it. One end portion 50*a* of the package 50 is inserted into the collecting chamber 56 through the opening 58 and fixed to the casing 40 by a pin 72. The top of the casing 40 in provided with an opening 74, which is located in opposite to the package 50 in the chamber 44 and which is closed by a seal member 76 with a slit 76*a*.

When the package 50 is to be opened after the developing unit 13 is set in the apparatus body 1, a tool 80 having a sharp tip such as a needle or a pencil is inserted into the casing 40 through the slit 76*a* of the seal member 76, as shown in FIG. 17. The sharp tip of the tool 80 is then stuck into the package 50. The package 50 is thus burst and opened, allowing the toner T in it to drop in the storing chamber 44. The burst package 50 shrinks rapidly and is accepted into the package collecting chamber 56 through the opening 58, as shown in FIG. 20.

The same merits as those achieved by the first example can also be attained by the third example, which is arranged as described above. Further, the third example enables the package 50 to be more easily opened.

It should be understood that the present invention is not limited to the above-described embodiments and that various changes and modifications can be made without departing from the scope of the present invention.

Although more component developer consisting of toner is used in the above-described examples, two-component developer consisting of toner and carrier may be used.

Figure 21:
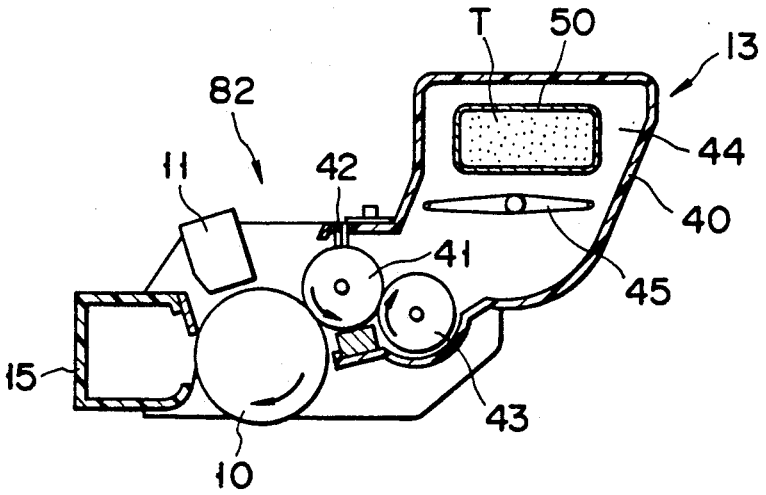
FIG. 21 is a side view, partly broken off, showing a case where the present invention is applied to an image forming apparatus provided with a process unit.

Although the developing device is made independent of the body of the image forming apparatus and detachably set in the apparatus body in the abovedescribed examples, the present invention can be applied to an image forming apparatus in which a photoconductive drum 10, charger 11, developing device 13 and cleaning unit 15 are made as a unit, as shown in FIG. 21. Specifically, these components 10, 11, 13 and 15 are mounted on a common support frame to form a processing unit 82, which is removably set in the apparatus body. Before the processing unit 82 is set in the apparatus body, developer is stored in the casing 40 of the developing device 13 while being sealed in a package 50. Even when the developing device is formed as a part of the processing unit 82 as described above, leaking and scattering of the developer can be reliably prevented during the transportation of the processing unit 82. In addition, the processing unit 82 can be easily set in the apparatus body.

What is claimed is:

1. A developing device adapted for an image forming apparatus, comprising:

a casing removably mounted in the image forming apparatus;

a package housed in the casing in which developer is sealed; and means, located in the casing, for opening the package to supply the developer sealed in the package into the casing, the opening means having a slitting member and means for winding the package through the slitting member to squeeze the package so as to increase the pressure in the package.

2. A device according to claim 1, wherein said package has an end openable in response to the increase in pressure in the package.

3. A device according to claim 2, wherein said pressure increasing means includes a partition wall located in the casing and provided with a slit, and means for winding the package through the slit to squeeze the package so as to increase the pressure in the package.

4. A device according to claim 2, wherein said package has a closed end opposed to the openable end thereof and passed through the slitting member, and said winding means has a winding shaft rotatably arranged in the casing to which the closed end of the package is fixed, and means for rotating the winding shaft to wind up the package.

5. A device according to claim 4, wherein said winding shaft has an end projecting outside the casing, and said shaft rotating means has a knob attached to the projected end of the winding shaft.

6. A device according to claim 4, wherein said winding shaft has an end projecting outside the casing, and said shaft rotating means has a motor attached to the casing and a member for transmitting the rotation of the motor to the projected end of the winding shaft.

7. A device according to claim 4, wherein said winding shaft has an end projecting outside the casing, and said shaft rotating means has a gear attached to the projected end of the winding shaft and a motor located on the side of the image forming apparatus to drive the winding shaft through the gear.

8. A device according to claim 2, wherein said casing has a chamber for collecting the wound package therein.

9. A processing unit detachably mountable in an image forming apparatus comprising:

an image bearing member on which a latent image is formed;

means for developing the latent image on the image bearing member by means of developer, said developing means including a chamber member, and a package housed in the chamber member and sealing the developer therein, and means for squeezing the package so as to open the package such that the developer sealed in the package is supplied from the package into the chamber member.

10. A developing device adapted for an image forming apparatus, comprising:

means for sealing a developing article;

means for housing the sealing means, the housing means having a passing portion for permitting the sealing means to be removed from the housing means;

means, provided at the housing means, for squeezing the sealing means so as to open the sealing means when the sealing means is removed from the housing means through the passing portion, such that the developing particle sealed in the sealing means is supplied from the sealing means into the housing means; and means for preventing the developing particles from spilling outside the housing means through the passing portion.

11. A device according to claim 10, wherein said squeezing means has a plug member fitted to said passing portion to close the passing portion, the plug member having a slit through which the sealing means is removed from the housing means and squeezed by the plug member.

12. A device according to claim 11, wherein said preventing means includes a seal member, with elasticity, attached to the plug member, for elastically closing the slit of the plug member.

13. A device according to claim 12, wherein said seal member has a slit through which the sealing means is removed from the housing means and which is closed by the elasticity of the seal member.

14. A device according to claim 11, wherein said sealing means includes a package having an end openable in response to increase in pressure in the package and a closed end opposite to the openable end, the closed end projecting outside the housing means through the slit of the new plug member.

15. A developer device adapted for an image forming apparatus, comprising:

a package for sealing a one-component developer;

a casing for housing the package, the casing having a chamber for receiving the one-component developer from the package member and an opening portion for permitting the package to be removed from the casing;

means, provided at the casing, for squeezing the package so as to open the package when the package is removed from the casing through the opening portion, k such that the one-component developer sealed in the package is supplied from the package into the chamber;

a sealing member, provided at the opening portion, for preventing the one-component developer from spilling outside the casing through the passing portion; and roller means, rotatably located in the casing, for carrying the one-component developer housed in the chamber to an image bearing member on which a latent image is formed.

* * * * *